US006308471B1

(12) United States Patent
Raynor

(10) Patent No.: US 6,308,471 B1
(45) Date of Patent: Oct. 30, 2001

(54) UNDERGROUND BELOW BUILDING BUNKER

(76) Inventor: Earlston Raynor, 140 Orchard Woods, Deltona, FL (US) 32713

( * ) Notice: Subject to any disclaimer, the term of this patent is extended or adjusted under 35 U.S.C. 154(b) by 0 days.

(21) Appl. No.: 09/572,222

(22) Filed: May 17, 2000

(51) Int. Cl.[7] ..... E02D 27/00
(52) U.S. Cl. ..... 52/169.6
(58) Field of Search ..... 52/19, 20, 169.6, 52/79.1

(56) References Cited

U.S. PATENT DOCUMENTS

| | | | | |
|---|---|---|---|---|
| 3,173,387 | | 3/1965 | Cree, Jr. . | |
| 4,126,972 | | 11/1978 | Silen . | |
| 4,539,780 | | 9/1985 | Rice . | |
| 4,615,158 | | 10/1986 | Thronton . | |
| 4,955,166 | * | 9/1990 | Qualline et al. | 52/169.6 |
| 5,979,128 | * | 11/1999 | Parsons | 52/169.6 |
| 6,076,313 | * | 6/2000 | Pannell et al. | 52/169.6 |

FOREIGN PATENT DOCUMENTS

| | | |
|---|---|---|
| 2589899 | 5/1987 | (FR) . |
| 2078272 | 6/1980 | (GB) . |
| 2081333 | 2/1982 | (GB) . |
| 52-233 | 1/1982 | (JP) . |
| 57-6025 | 1/1982 | (JP) . |

* cited by examiner

*Primary Examiner*—Richard Chilcot
(74) *Attorney, Agent, or Firm*—Edward M. Livingston, Esq.

(57) ABSTRACT

An underground below-building bunker has bunker quarters (1) positioned under ground (2) below a dwelling-related structure (3), such as a garage, a room or a hallway of a dwelling (4). A floor-entry door (5) such as a trapdoor, horizontal slide door or other through-floor entry leads to a vertical passageway (6) where a bunker door (7) provides entrance to a stairway (8) or ladder (9) to a bunker floor (10). A buffer zone of protection is provided in the vertical passageway intermediate the floor-entry door and the bunker door, which in combination provide a predetermined level of protection against foreseeable hazards. The ground below the dwelling-related structure has a depth at which enclosure structure (12) of the bunker quarters can provide protection against predetermined hazards. Air vents (15, 17) into separate portions of the bunker quarters provide safety redundance of air from safe-air sources (19). Outside communication with preferably a wireless phone (21), lights (22), storage (23), water (24), food (25), sewage disposal (26) and other features are provided selectively.

15 Claims, 1 Drawing Sheet

UNDERGROUND BELOW BUILDING BUNKER

BACKGROUND OF THE INVENTION

This invention relates to underground bunkers such as storm shelters and in particular to bunkers under ground below buildings such as garages and dwellings.

Outdoor storm shelters and bunkers are well known. There are some under floors of buildings. None are known, however, to be underground below a building in a working relationship to the building as taught by this invention.

Examples of known related but different underground storm shelters and bunkers are described in the following patent documents. French Patent No. FR2589-899-A, issued to Della on May 15, 1987, described a cellar-like security chamber below a floor of a building but not under foundation ground below a building with security doors in working relationship to the building as taught by this invention. Other under-floor security chambers are taught by Japanese Patent Application No. 55-80392, filed on Jun. 14, 1980; and Japanese Patent Application No. 55-73312, filed on May 31, 1980. Underground outdoor bunkers are described by UK Patent Application No. 2 078 272 A, filed on Jun. 14, 1980; UK Patent Application No. 2 081 333 A, filed on Feb. 17, 1982; U.S. Pat. No. 4,539,780, issued to Rice on Sep. 10, 1985; U.S. Pat. No. 4,615,158, issued to Thornton on Oct. 7, 1986; and U.S. Pat. No. 3,173,387, issued to Cree, Jr. on Mar., 16, 1965. An above-ground tornado-protection building is described in U.S. Pat. No. 4,126,972, issued to Silen on Nov. 28, 1978.

SUMMARY OF THE INVENTION

Objects of patentable novelty and utility taught by this invention are to provide an underground below-building bunker which:

can be accessed quickly and conveniently from within a building;

conserves use of land by positioning below a building; and provides protection from tornados, hurricanes, fire, burglary and radioactivity.

This invention accomplishes these and other objectives with an underground below-building bunker having a security chamber positioned under foundation ground below a garage, a dwelling or extension of a dwelling. A floor door such as a trap door, horizontal slide door or other through-floor entry leads to a vertical passage through under-building ground where a bunker door provides entrance to a stairway to bunker quarters. Air vents into separate portions of the bunker quarters provide safety redundance of air supply. Storage, lights and facilities can be provided.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
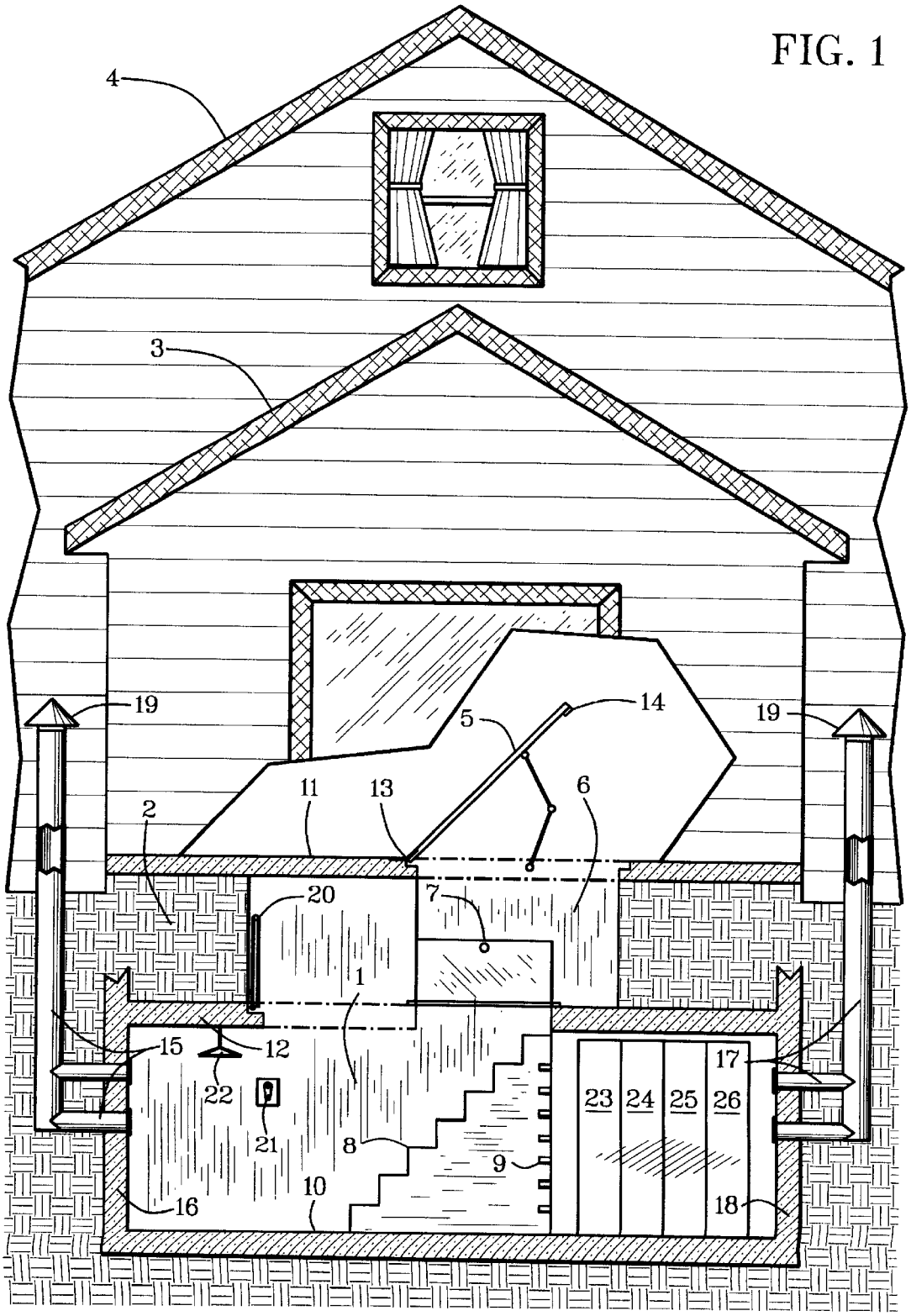
FIG. 1 is a partially cutaway elevation view.

Listed numerically below with reference to the drawings are terms used to describe features of this invention. These terms and numbers assigned to them designate the same features throughout this description. 1. Bunker quarters 2. Ground 3. Dwelling-related structure 4. Dwelling 5. Floor-entry door 6. Vertical passageway 7. Bunker door 8. Stairway 9. Ladder 10. Bunker floor 11. Structure floor 12. Enclosure structure 13. Hinge 14. Lock 15. First air conveyance 16. First wall 17. Second air conveyance 18. Second wall 19. Safe-air source 20. Stairway door 21. Wireless phone 22. Lights 23. Storage 24. Water 25. Food 26. Sewage disposal Referring to FIG. 1, bunker quarters 1 are positioned under ground 2 below a dwelling-related structure 3 that is related to a dwelling 4. A floor-entry door 5 leads to a vertical passageway 6 through the ground 2 to a bunker door 7. Steps such as a stairway 8 or a ladder 9 lead from the bunker door 7 to a bunker floor 10.

The dwelling-related structure 3 is preferably a garage but can be a room, a hallway or other related structural entity having a structure floor 11 to which the floor-entry door 5 is attached pivotally.

The ground 2 below the dwelling-related structure 3 has a depth at which enclosure structure 12 of the bunker quarters 1 can provide protection against predetermined hazards.

The floor-entry door 5 is preferably an uplifting trapdoor having a hinge 13 and a lock 14 structured for withstanding foreseeable hazards.

The bunker door 7 can be a redundancy protection against foreseeable hazards not provided by the floor-entry door 5. This allows the floor-entry door to be blended into the structure floor 11 and to be ablative in fires, with the bunker door 7 being structured for fireproofness and other protective characteristics. Optionally, both the floor-entry door 5 and the bunker door 7 can be predeterminedly fireproof, stormproof, and/or burglarproof with the vertical passageway 6 providing a buffer zone of protection.

The at least one air conveyance can include a first air conveyance 15 in a first wall 16 and a second air conveyance 17 in a second wall 18 of the bunker quarters 1 for reliability redundance of air supply from safe-air sources 19.

For bunker quarters 1 with the stairway 8 and having minimal space, a stairway door 20 can be provided to accommodate body height on the stairway 8. For yet smaller areas or increased use of available space, the ladder 9 obviates need for the stairway door 20.

The bunker quarters 1 can have outside communications such as a wireless phone 21, lights 22, storage 23, water 24, food 25, sewage disposal 26 and other schematically represented features selectively.

A new and useful underground below-building bunker having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An underground below-building bunker comprising:

bunker quarters positioned under ground below a dwelling-related structure;

a floor-entry door leading to a vertical passageway through under-buildingground to a bunker door;

a bunker door on the bunker quarters;

steps from the bunker door to a bunker floor of the bunker quarters; and at least one air conveyance from a safe-air source through at least one wall of the bunker quarters.

2. The underground below-building bunker of claim 1 wherein:

the dwelling-related structure is a garage.

3. The underground below-building bunker of claim 1 wherein:

the dwelling-related structure is a room in a dwelling.

4. The underground below-building bunker of claim 1 wherein:

the dwelling-related structure is a hallway in the dwelling.

5. The underground below-building bunker of claim 1 wherein:

the ground below the dwelling-related structure has a depth at which enclosure structure of the bunker quarters can provide protection against predetermined hazards.

6. The underground below-building bunker of claim 1 wherein:

the floor-entry door is a trapdoor in a floor of the dwelling-related structure.

7. The underground below-building bunker of claim 6 wherein:

the trapdoor is blended with surrounding structure for hiding of its existence.

8. The underground below-building bunker of claim 7 wherein:

the trapdoor is an uplifting trapdoor having hinge and lock structure for withstanding foreseeable hazards.

9. The underground below-building bunker of claim 1 wherein:

the steps are a stairway.

10. The underground below-building bunker of claim 1 wherein:

the steps are a ladder.

11. The underground below-building bunker of claim 1 wherein:

the bunker door is a redundancy protection against foreseeable hazards not provided by the floor-entry door.

12. The underground below-building bunker of claim 1 wherein:

the at least one air conveyance includes a first air conveyance in a first wall and a second air conveyance in a second wall of the bunker quarters for redundance reliability of air supply from safe-air sources.

13. The underground below-building bunker of claim 1 wherein:

the bunker quarters has external communications, lights, storage, water, food, sewage and other features selectively.

14. An underground below-building bunker comprising:

bunker quarters positioned under ground below a dwelling-related structure;

a floor-entry door leading to a vertical passageway through under-building ground to a bunker door;

a bunker door on the bunker quarters;

a buffer zone of protection in the vertical passageway intermediate the floor-entry door and the bunker door which in combination provide a predetermined level of protection against foreseeable hazards;

the ground below the dwelling-related structure having a depth at which enclosure structure of the bunker quarters can provide protection against predetermined hazards;

steps from the bunker door to a bunker floor of the bunker quarters; and at least one air conveyance from the safe-air source through at least one wall of the bunker quarters.

15. The underground below-building bunker of claim 14 wherein:

the bunker quarters has external communications, lights, storage, water, food, sewage disposal and other features selectively.

* * * * *